US009728939B2

(12) United States Patent
Obe

(10) Patent No.: US 9,728,939 B2
(45) Date of Patent: Aug. 8, 2017

(54) IGNITER

(71) Applicant: ROHM CO., LTD., Ukyo-Ku, Kyoto (JP)

(72) Inventor: Katsuya Obe, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 115 days.

(21) Appl. No.: 14/876,054

(22) Filed: Oct. 6, 2015

(65) Prior Publication Data

US 2016/0105001 A1 Apr. 14, 2016

(30) Foreign Application Priority Data

Oct. 8, 2014 (JP) ..... 2014-207427

(51) Int. Cl.

| | |
|---|---|
| ***F02P 3/08*** | (2006.01) |
| ***H01T 15/00*** | (2006.01) |
| ***F02P 3/055*** | (2006.01) |
| *F02P 3/045* | (2006.01) |
| *F02P 5/15* | (2006.01) |

(52) U.S. Cl.

CPC ..... *H01T 15/00* (2013.01); *F02P 3/055* (2013.01); *F02P 3/045* (2013.01); *F02P 5/1506* (2013.01)

(58) Field of Classification Search

CPC . H01T 15/00; F02P 3/055; F02P 3/045; F02P 3/04; F02P 3/0407; F02P 3/0414; F02P 3/0442; F02P 3/08; F02P 5/1506

USPC ..... 123/605, 618, 621, 623

See application file for complete search history.

(56) References Cited

FOREIGN PATENT DOCUMENTS

| | | |
|---|---|---|
| JP | 2011185165 A | 9/2011 |
| JP | 2014051904 A | 3/2014 |

*Primary Examiner* — Hai Huynh

(74) *Attorney, Agent, or Firm* — Cantor Colburn LLP

(57) ABSTRACT

An igniter includes a switch element and a switch control apparatus. An ignition signal IGT is input to an input line of the switch control apparatus. A high-frequency filter removes high-frequency noise from the input line. A voltage comparator compares an output voltage $V_{FIL}$ of the high-frequency filter with a reference voltage $V_{REF}$, so as to generate a judgment signal $S_{DET}$. A driving stage controls an on/off switching operation of the switch element according to the judgment signal $S_{DET}$. An off-state dead-time circuit prohibits the switch element from turning off during a predetermined dead time after the judgment signal $S_{DET}$ transits to a negated level that corresponds to the off state of the switch element.

7 Claims, 11 Drawing Sheets

100

100

IGNITER

CROSS-REFERENCE TO RELATED APPLICATIONS

The present invention claims priority under 35 U.S.C. §119 to Japanese Application No. 2014-207427, filed Oct. 8, 2014, the entire content of which is incorporated herein by reference.

BACKGROUND OF THE INVENTION

Field of the Invention

The present invention relates to an igniter that controls an ignition coil connected to a spark plug of an engine.

Description of the Related Art

FIG. 1 is a perspective view of an engine room 101 provided to a gasoline-engine vehicle (which will also be referred to simply as the "vehicle" hereafter) 100. The engine room 101 houses an engine 110, an intake manifold 112, an air cleaner 113, a radiator 114, a battery 102, and the like. FIG. 1 shows a four-cylinder engine.

The engine 110 is provided with a plug hole (not shown) for each cylinder. A spark plug (not shown) is inserted into each plug hole. Each cylinder of the engine 110 receives a supply of a mixture of air transmitted via the air cleaner 113 and the intake manifold 112 and a fuel gas supplied from an unshown fuel tank. Each spark plug is ignited (a spark is generated) at an appropriate timing, so as to start rotational driving of the engine.

FIG. 2 is a block diagram showing a part of an electrical system of a vehicle 100*r*. The vehicle 100*r* includes a battery 102, an ignition coil 104, a spark plug 106, an ECU 108, and an igniter 200. The ECU 108 generates an ignition signal IGT, which indicates an ignition timing for the spark plug 106, in a cyclic manner in synchronization with the rotation of the engine 110. A secondary coil L2 of the ignition coil 104 is connected to the spark plug 106. The igniter 200 controls the current that flows through a primary coil L1 of the ignition coil 104 according to the ignition signal IGT, so as to generate a high voltage (secondary voltage $V_S$) of several tens of kV at the secondary coil L2. This provides a discharge of the spark plug 106, thereby providing combustion of the mixture gas stored in the engine 110.

The igniter 200 includes a switch element 202 and a switch control apparatus 300*r*. The switch element 202 is configured as an IGBT (Insulated Gate Bipolar Transistor) arranged such that its collector is connected to the primary coil L1 and its emitter is grounded. The switch control apparatus 300*r* controls the voltage at the control terminal (gate) of the switch element 202 according to the ignition signal IGT, so as to control the on/off operation of the switch element 202. Specifically, during a period in which the ignition signal IGT is set to high level, the switch element 202 is turned on. When the switch element 202 is turned on, a battery voltage $V_{BAT}$ is applied between both ends of the primary coil L1. In this state, a current that flows through the primary coil L1 rises with time. When the ignition signal IGT is switched to low level, the switch control apparatus 300*r* immediately turns off the switch element 202, which cuts off the current $I_{L1}$ that flows through the primary coil L1. In this stage, the primary coil L1 generates a primary voltage $V_{L1}$ ($=L \cdot dI_{L1}/dt$) of several hundreds of V which is proportional to a temporal differentiation of the current $I_{L1}$. In this state, the coil L2 generates a secondary voltage $V_S$ of several tens of kV, which can be calculated by multiplying the primary voltage $V_{L1}$ by the winding ratio.

The switch control apparatus 300*r* includes a judgment stage 300A configured as a first stage and a driving stage 300B configured as a second stage. The judgment stage 300A receives the ignition signal IGT from the ECU 108, and judges the level (high level or low level) of the ignition signal IGT. Typically, such an igniter 200 is employed in the engine room. Accordingly, the igniter 200 is exposed to various kinds of surges and noise. In order to suppress a malfunction of the igniter 200 due to high-frequency noise, the judgment stage 300A is provided with a high-frequency filter 303 that removes high-frequency noise superimposed on the ignition signal IGT. A voltage comparator 302 compares the voltage level $V_{FIL}$ of the ignition signal IGT that has passed through the high-frequency filter 303 with a predetermined reference voltage (threshold value) $V_{REF}$, so as to generate a binary judgment signal $S_{DET}$ that is set to high level or otherwise low level.

The driving stage 300B switches the switch element 202 between the on state and the off state according to the judgment signal $S_{DET}$. A delay circuit 304 applies a predetermined delay to the judgment signal $S_{DET}$. The amount of delay is set such that the time difference (delay) between the transition of the ignition signal IGT and the time point at which the spark plug is discharged matches a predetermined value. The pre-driver 306 and the gate driver 308 control the gate voltage of the switch element 202 according to the output of the delay circuit 304.

As a result obtained by investigating the igniter 200*r* shown in FIG. 2, the present inventors have come to recognize the following problem. FIG. 3 is an operation waveform diagram showing the operation of the igniter 200*r* shown in FIG. 2.

At the time point t0, the ignition signal IGT is asserted (set to high level) by the ECU 108. This increases the voltage $V_{FIL}$ of the signal to be input to the voltage comparator 302 after it passes through the high-frequency filter 303. In this state, during a period in which $V_{FIL}>V_{REF}$, the judgment signal $S_{DET}$ is asserted (set to high level). During a period in which the judgment signal $S_{DET}$ is set to high level, the switch element 202 is turned on, which raises the coil current Ic.

At the time point t1, the ignition signal IGT is negated (set to low level) by the ECU 108. The judgment signal $S_{DET}$ is switched to low level according to the negation, which turns off (cuts off) the switch element 202. In this state, the large voltage $V_S$ generated by the secondary coil L2 of the ignition coil 104 is applied to the spark plug 106, thereby providing ignition.

When the ignition signal IGT is switched to low level, the voltage $V_{FIL}$, which has passed through the filter and which is to be input to the voltage comparator 302, drops with a delay due to the capacitance of the high-frequency filter 303. Spark noise (cut-off noise) occurs due to the ignition of the spark plug 106, which is input to the switch control apparatus 300 via the input terminal IN. If a charge remains in the capacitor of the high-frequency filter 303 at the timing t2 at which spark noise occurs, the input voltage $V_{FIL}$ of the voltage comparator 302 exceeds the reference voltage $V_{REF}$, which asserts the judgment signal $S_{DET}$, leading to cut-off occurring again even if the ignition signal IGT remains at low level. The above-described problem is by no means within the scope of common and general knowledge in the field of the present invention. Furthermore, it can be said that this problem has been uniquely recognized by the present inventor.

SUMMARY OF THE INVENTION

The present invention has been made in order to solve such a problem. Accordingly, it is an exemplary purpose of an embodiment of the present invention to provide an igniter which is capable of preventing cut-off from occurring again immediately after ignition.

An embodiment of the present invention relates to a igniter comprising: a switch element connected to a primary coil of an ignition coil; and a switch control apparatus that controls the switch element according to an ignition signal supplied from an ECU (Engine Control Unit). The switch control apparatus comprises: an input line via which the ignition signal is supplied; a filter that removes high-frequency noise from the input line; a voltage comparator that compares an output voltage of the filter with a reference voltage, so as to generate a judgment signal; a driving stage that controls an on/off switching operation of the switch element according to the judgment signal; and an off-state dead-time circuit that prohibits the driving stage from turning off the switch element during a predetermined dead time after the judgment signal transits to a negated level that corresponds to an off state of the switch element.

With such an embodiment, a dead-time period is provided immediately after ignition provided according to an ignition signal. The switch element is prohibited from turning off during the dead-time period regardless of the level of the judgment signal. Such an arrangement is capable of preventing cutting-off from occurring again due to spark noise that occurs in the igniter itself.

Also, the off-state dead-time circuit may comprises: a mask signal generating circuit that receives the judgment signal, and that generates a mask signal which is set to a predetermined level during the dead time after the judgment signal transits to the negated level; and a logic gate that performs a logical operation on the mask signal and a control signal, wherein the control signal is generated according to the judgment signal, and the control signal instructs the switch element to turn on and off.

Also, the mask signal generating circuit may comprise: an edge detection circuit that asserts a start signal when a negative edge is detected in the judgment signal; a timer circuit that asserts an end signal after the dead time elapses after the start signal is asserted; and a flip-flop that generates the mask signal, which is switched to the predetermined level when the start signal is asserted, and which is switched to a complementary level of the predetermined level when the end signal is asserted.

Another embodiment of the present invention also relates to an igniter. The igniter comprises: a switch element connected to a primary coil of an ignition coil; and a switch control apparatus that controls the switch element according to an ignition signal supplied from an ECU (Engine Control Unit). The switch control apparatus comprises: an input line via which the ignition signal is supplied; a filter that removes high-frequency noise from the input line; a voltage comparator that compares an output voltage of the filter with a reference voltage, so as to generate a judgment signal; a driving stage that controls an on/off switching operation of the switch element according to the judgment signal. The igniter is configured such that the switch element is maintained in an off state during a predetermined dead time after the judgment signal transits to a negated level that corresponds to an off state of the switch element.

Also, the switch control apparatus may be monolithically integrated on a single semiconductor substrate.

Examples of such a "monolithically integrated" arrangement include: an arrangement in which all the circuit components are formed on a semiconductor substrate; and an arrangement in which principal circuit components are monolithically integrated. Also, a part of the circuit components such as resistors and capacitors may be arranged in the form of components external to such a semiconductor substrate in order to adjust the circuit constants.

Yet another embodiment of the present invention relates to a vehicle. The vehicle comprises gasoline engine; spark plug; an ignition coil comprising a primary coil and a secondary coil connected to the spark plug; an ECU that generates an ignition signal configured as an instruction to ignite the spark plug; and any one of the aforementioned igniters, that drive the ignition coil according to the ignition signal.

It is to be noted that any arbitrary combination or rearrangement of the above-described structural components and so forth is effective as and encompassed by the present embodiments.

Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

In the present specification, the state represented by the phrase "the member A is connected to the member B" includes a state in which the member A is indirectly connected to the member B via another member that does not affect the electric connection therebetween, in addition to a state in which the member A is physically and directly connected to the member B.

Similarly, the state represented by the phrase "the member C is provided between the member A and the member B"

includes a state in which the member A is indirectly connected to the member C, or the member B is indirectly connected to the member C via another member that does not affect the electric connection therebetween, in addition to a state in which the member A is directly connected to the member C, or the member B is directly connected to the member C.

Figure 1:
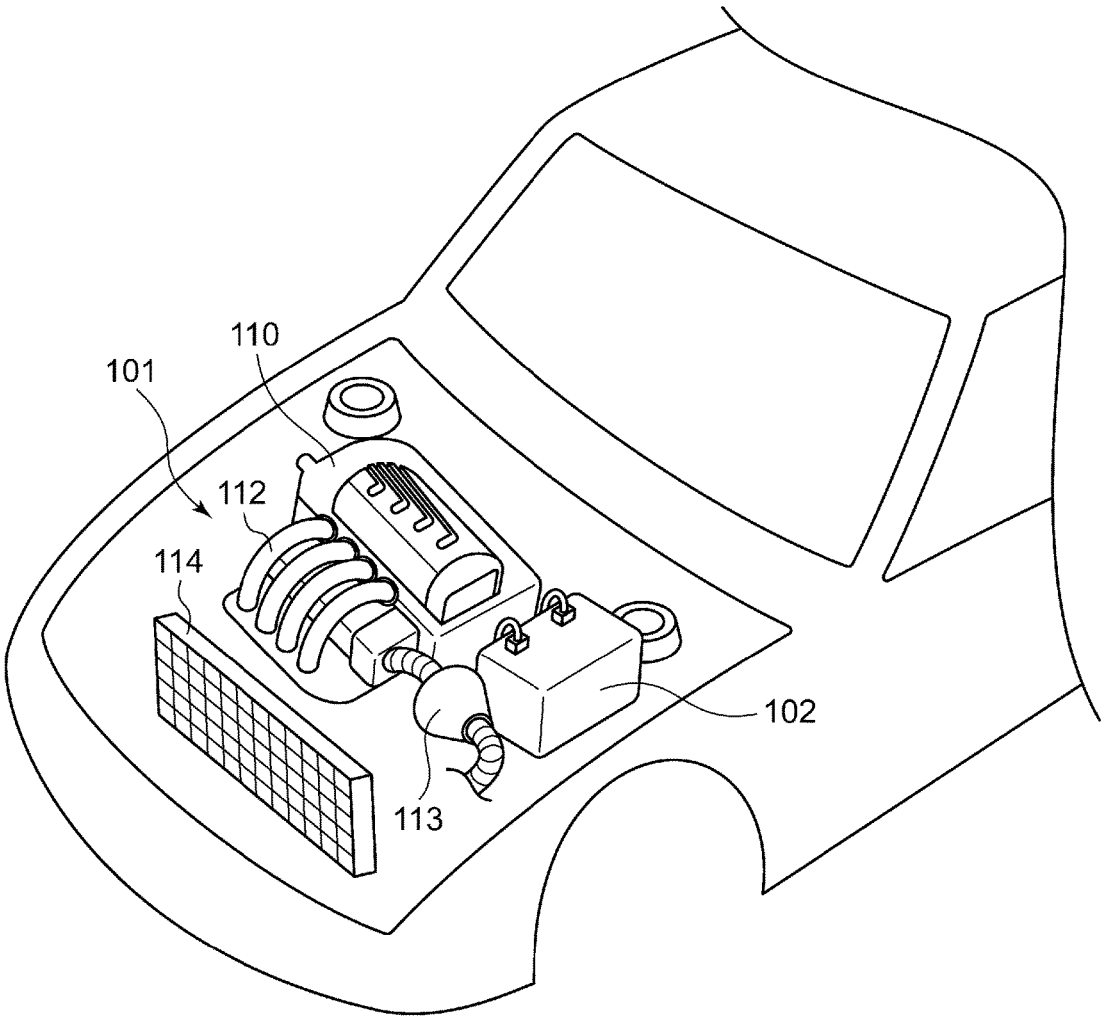
FIG. 1 is a perspective view of an engine room included in a gasoline-engine vehicle.
Figure 2:
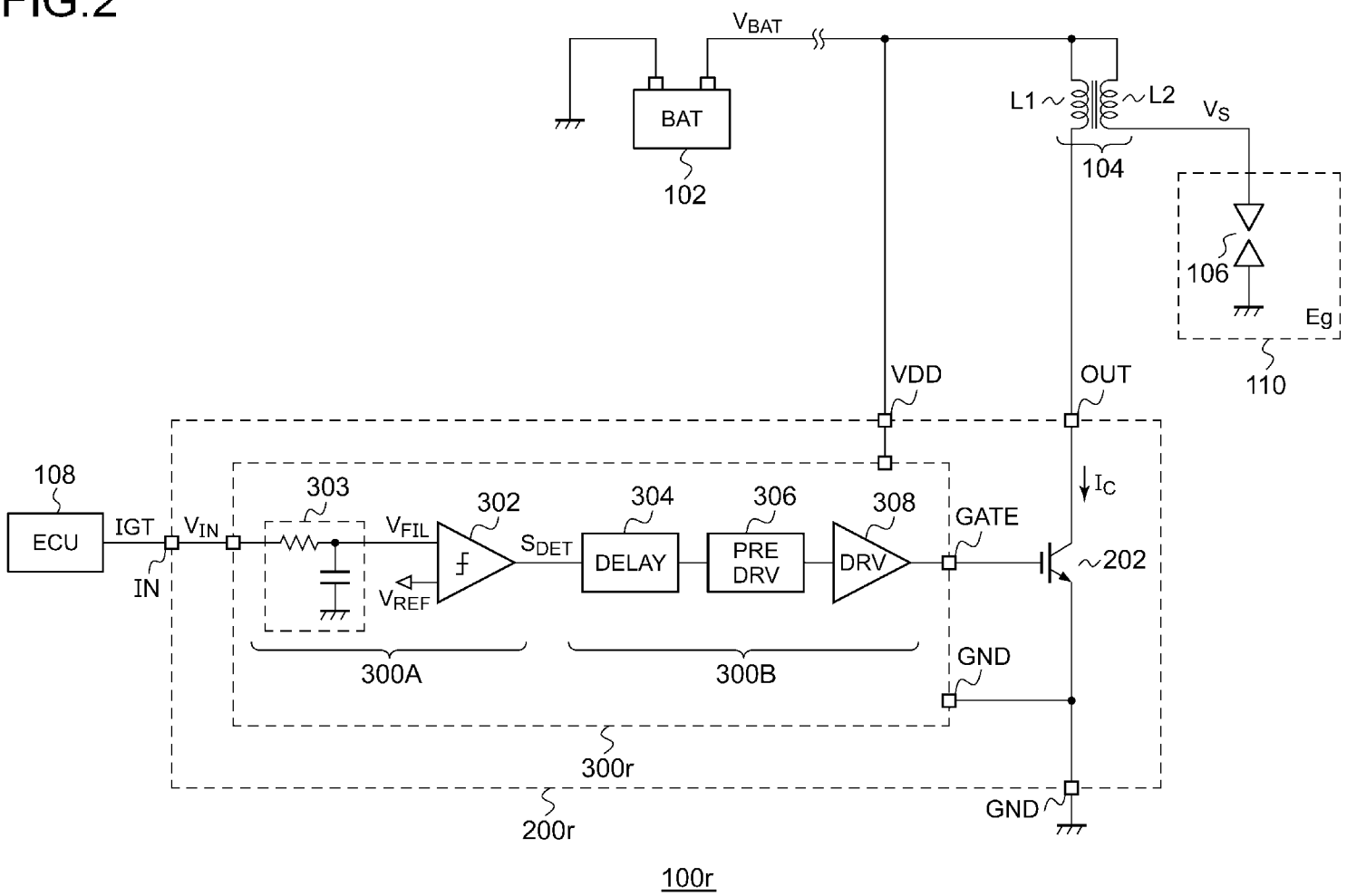
FIG. 2 is a block diagram showing a part of an electrical system of the vehicle.
Figure 3:
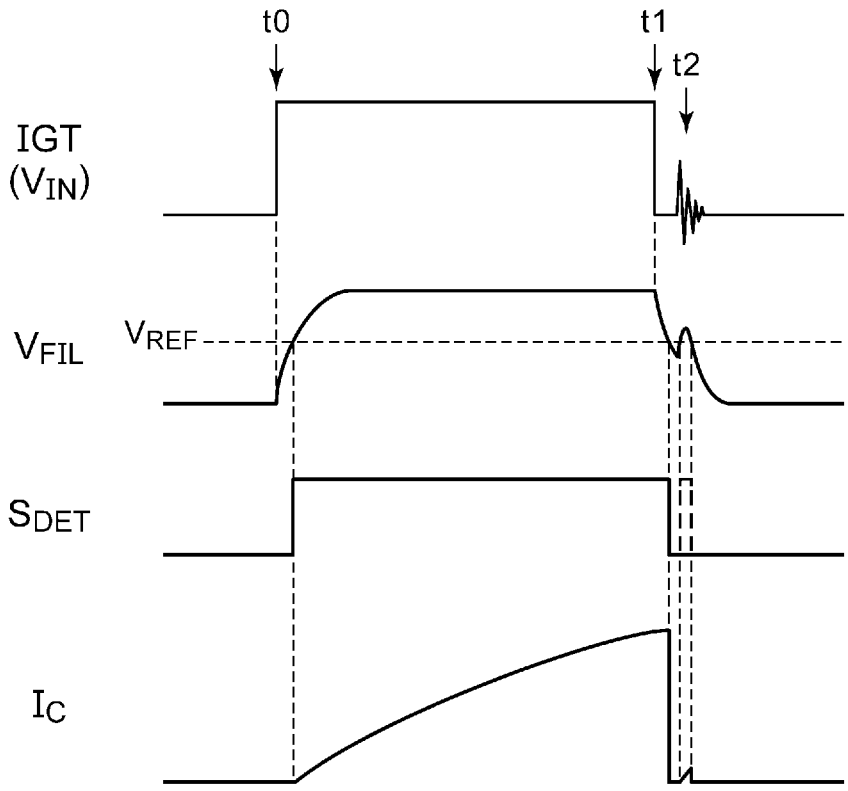
FIG. 3 is an operation waveform diagram showing the operation of an igniter shown in FIG. 2.
Figure 4:
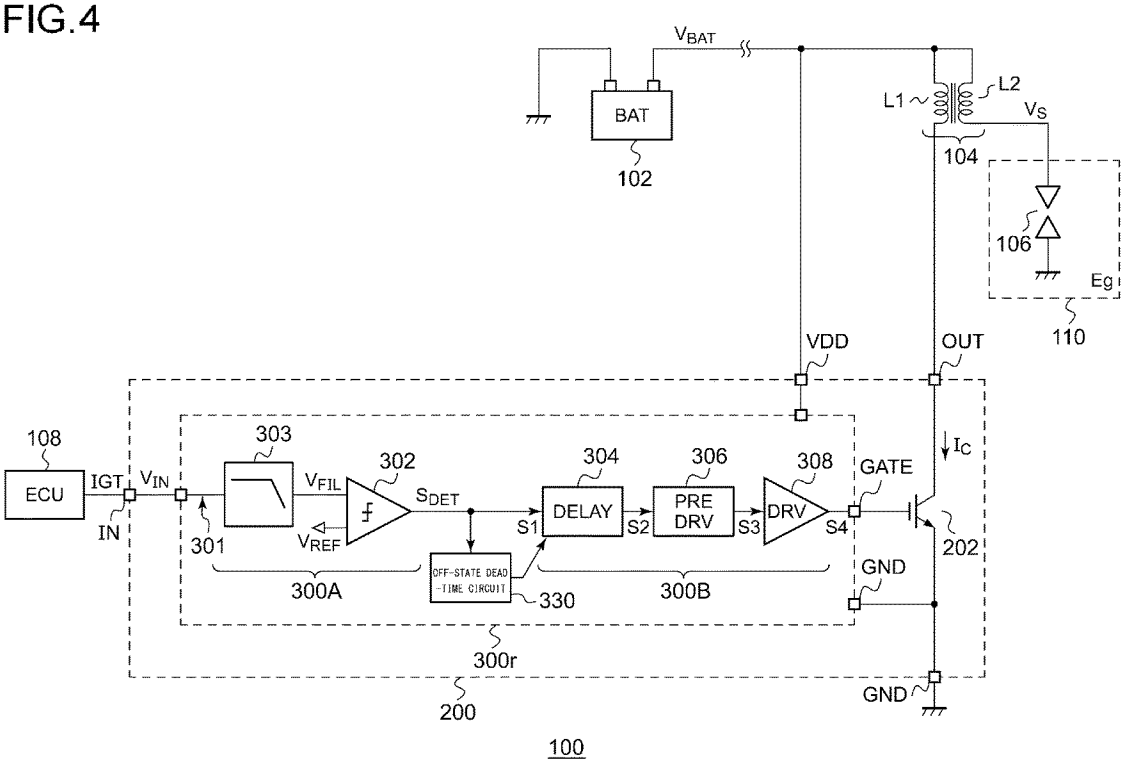
FIG. 4 is a circuit diagram showing an igniter according to an embodiment.

FIG. 4 is a circuit diagram showing an igniter 200 according to an embodiment. The igniter 200 includes a switch element 202 and a switch control apparatus 300. The switch control apparatus 300 has the same basic configuration as that shown in FIG. 2. Specifically, the switch control apparatus 300 includes a judgment stage 300A and a driving stage 300B, and is configured as a function IC monolithically integrated on a single semiconductor substrate.

The judgment stage 300A includes a high-frequency filter 303 and a voltage comparator 302. The input line 301 receives an ignition signal IGT as its input signal from an ECU 108. The high-frequency filter 303 removes high-frequency noise from the input line 301.

The voltage comparator 302 compares the output voltage $V_{FIL}$ of the high-frequency filter 303 with a reference voltage $V_{REF}$, so as to generate a judgment signal $S_{DET}$. In the present embodiment, a state in which $V_{FIL}>V_{REF}$ ($V_{IN}>V_{REF}$) corresponds to the on state of a switch element 202. Conversely, a case in which $V_{FIL}<V_{REF}$ ($V_{IN}<V_{REF}$) corresponds to the off state of a switch element 202. Furthermore, when $V_{FIL}>V_{REF}$, the judgment signal $S_{DET}$ is set to high level (asserted). Conversely, when $V_{FIL}<V_{REF}$, the judgment signal $S_{DET}$ is set to low level (negated). Accordingly, the high level of the judgment signal $S_{DET}$ is an assertion level, which corresponds to the on state of the switch element 202. In contrast, the low level of the judgment signal $S_{DET}$ is a negation level, which corresponds to the off state of the switch element 202. It should be noted that the assignment of the assertion state and the negation state to the high level and the low level is no more than a matter of design choice. Thus, such assignment may be mutually exchanged as appropriate.

The driving stage 300B controls an on/off operation of the switch element 202 according to the judgment signal $S_{DET}$ generated by the judgment stage 300A. The driving stage 300B includes a delay circuit 304, a pre-driver 306, and a gate driver 308.

The switch control apparatus 300 included in the igniter 200 further includes an off-state dead-time circuit 330. The off-state dead-time circuit 330 prohibits the driving stage 300B from turning off the switch element 202 during a predetermined dead time $T_{DEAD}$ after the judgment signal $S_{DET}$, which is an output of the voltage comparator 302, transits to the negation level (low level), i.e., after a negative edge occurs in the judgment signal $S_{DET}$.

In the present embodiment, the off-state dead-time circuit 330 receives the judgment signal $S_{DET}$ from the voltage comparator 302, and sets the dead time $T_{DEAD}$ starting from a negative edge that occurs in the judgment signal $S_{DET}$. Furthermore, during the dead time $T_{DEAD}$, the off-state dead-time circuit 330 adjusts a signal that indicates the on/off state of the switch element 202, and specifically, adjusts the logical level of the input signal S1 or the output signal S4 of the driving stage 300B, or otherwise an intermediate signal S2 or S3, so as to prohibit the turning-off of the switch element 202.

Next, description will be made regarding the dead time $T_{DEAD}$. It is important for the dead time $T_{DEAD}$ to be preferably designed such that it has no effect on the ignition cycle in the normal operation. Specifically, the dead time $T_{DEAD}$ is preferably determined giving consideration to the following four periods of time Ta through Td.

(1) Igniter Lock Protection Timer Time Ta

In some cases, the upper limit (which is referred to as the "current supply protection time") Ta is set for the on time of the switch element 202. In this case, if the switch element 202 continuously turns on over the current supply protection time Ta, the switch element 202 is forcedly turned off. The power supply protection time Ta is set to a maximum of 200 ms, for example.

(2) Current Supply Time Tb in Starter Mode

In the start-up operation of the engine, the current supply time Tb set for the switch element 202 is designed such that it is longer than the current supply times Tc and Td in the rotational driving operation of the engine. For example, the current supply time Tb is set to a maximum of 150 ms.

(3) Current Supply Time Tc in a Low-Speed Rotational Driving Operation

In a case of employing a four-cycle in-line four-cylinder engine, when the engine is driven with a revolution of 500 rpm, the ignition cycle (period) Tcyc1 is set to 250 ms. In this case, the current supply time Tc is set to a maximum of 10 ms, which depends on the specifications of the vehicle, and particularly, depends on the battery voltage.

(4) Current Supply Time Td in a High-Speed Rotational Driving Operation

In a case of employing a four-cycle in-line four-cylinder engine, when the engine is driven with a revolution of 12,000 rpm, the ignition cycle (period) Tcyc2 is set to 10 ms. In this case, the current supply time Td is set to a maximum of 3 ms, which depends on the specifications of the vehicle, and particularly, depends on the battery voltage.

Figure 5A:
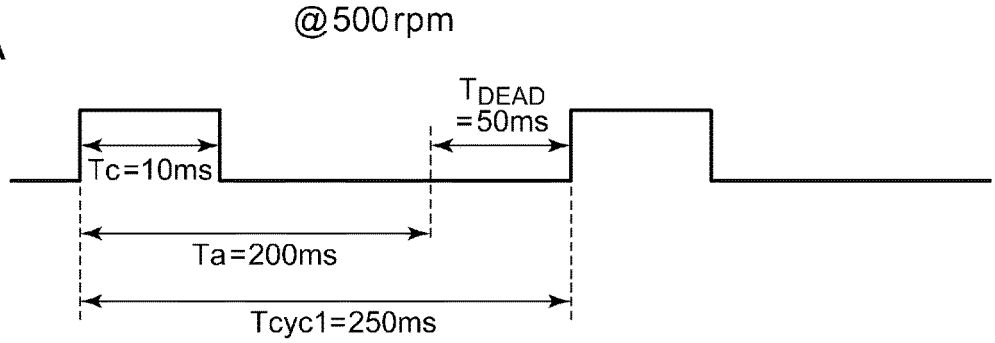
FIGS. 5A and 5B are diagrams showing an ignition cycle in a low-speed rotational driving operation and an ignition cycle in a high-speed rotational driving operation.
Figure 5B:
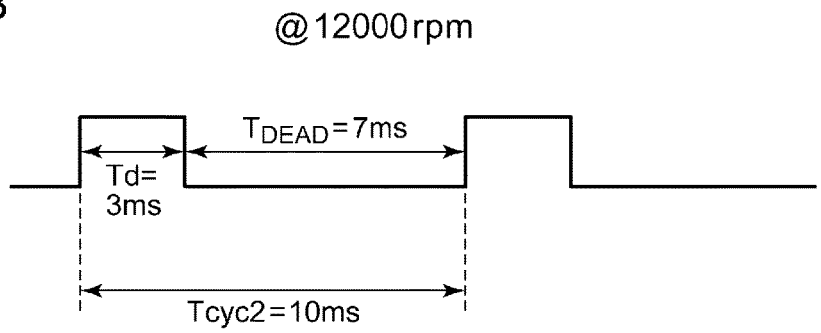

FIGS. 5A and 5B are diagrams showing an ignition cycle in the low-speed rotational driving operation and an ignition cycle in the high-speed rotational driving operation. It should be noted that there is a difference in the time scale between FIG. 5A and FIG. 5B. As shown in FIG. 5A, in a case in which the dead time $T_{DEAD}$ is designed giving consideration to only the low-speed rotational driving operation, the dead time $T_{DEAD}$ can be determined to be 50 ms (=250−200). However, in a case in which the dead time $T_{DEAD}$ thus calculated is applied to the high-speed rotational driving operation, the dead time $T_{DEAD}$ is longer than the ignition cycle time $T_{CYC}$ of 10 ms, leading to adverse effects on the normal ignition cycle. Thus, the dead time $T_{DEAD}$ may preferably be determined giving consideration to the ignition cycle time Tcyc2 derived based on the number of engine cylinders and the assumed maximum revolution and the current supply time Td set for the high-speed rotational driving operation. In this example, the dead time $T_{DEAD}$ may preferably be determined to be a value in a range that is shorter than 7 ms, which has no effect on the ignition cycle. As the dead time $T_{DEAD}$ becomes longer within this range, the probability of the occurrence of abnormal ignition due to spark noise becomes lower.

Figure 6:
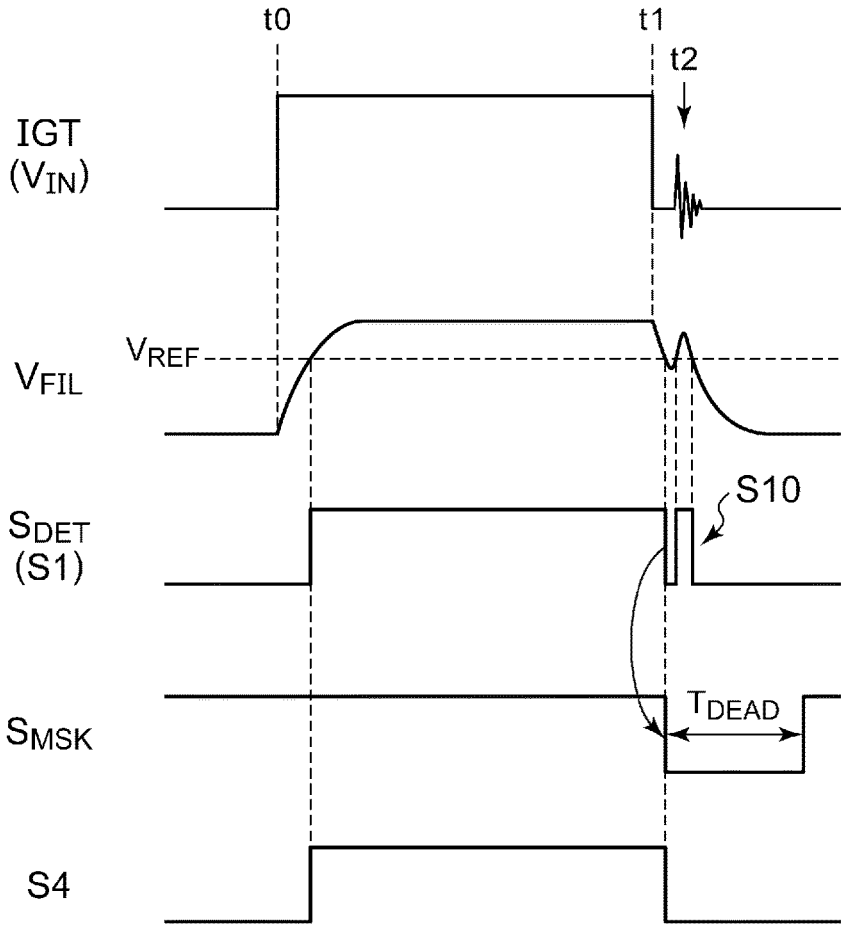
FIG. 6 is an operation waveform diagram showing the operation of the igniter according to the embodiment.

The above is the basic configuration of the igniter 200. Next, description will be made regarding the operation thereof. FIG. 6 is an operation waveform diagram showing the operation of the igniter 200 according to the embodiment. For ease of understanding, a propagation delay that occurs in the driving stage 300B is ignored.

At the time point t0, the ignition signal IGT is asserted (set to high level) by the ECU 108. This increases the voltage $V_{FIL}$ of the signal to be input to the voltage comparator 302 after it passes through the high-frequency filter 303. During a period in which $V_{FIL}>V_{REF}$, the judgment signal $S_{DET}$ is asserted (set to high level). During a period in which the judgment signal $S_{DET}$ is set to high level, the switch element 202 is turned on, which raises the coil current Ic.

At the time point t1, the ECU 108 negates (set to low level) the ignition signal IGT. In response to the negation of the ignition signal IGT, the judgment signal $S_{DET}$ transits to low level, which turns off (cuts off) the switch element 202. In this state, a high voltage generated by the secondary coil L2 of the ignition coil 104 is applied to the spark plug 106, thereby providing ignition.

When the ignition signal IGT is switched to low level, the voltage $V_{FIL}$ to be input to the voltage comparator 302 after it passes through the filter drops with a delay due to the capacitance of the high-frequency filter 303. Spark noise (cut-off noise) occurs due to the ignition of the spark plug 106, which is input to the switch control apparatus 300 via the input terminal IN. If a charge remains in the capacitor of the high-frequency filter 303 at the timing t2 at which spark noise occurs, the input voltage $V_{FIL}$ of the voltage comparator 302 exceeds the reference voltage $V_{REF}$, and the judgment signal $S_{DET}$ is asserted again, even if the ignition signal IGT remains in low level.

With such an arrangement, the dead time $T_{DEAD}$ is set as a start point with a negative edge that occurs in the judgment signal $S_{DET}$ according to an ignition instruction provided by the ignition signal IGT at the time point t1. During the dead time $T_{DEAD}$, a mask signal $S_{MSK}$ is set to low level. The mask signal $S_{MSK}$ masks a high level period S10 in which the judgment signal $S_{DET}$ is in the high level state due to noise. Thus, the gate signal S4 of the switch element 202 is maintained at low level.

As described above, the igniter 200 according to the embodiment is capable of preventing cut-off from occurring again immediately after the ignition.

The present invention encompasses various kinds of circuits that can be regarded as a block configuration shown in FIG. 4, or otherwise that can be derived by the aforementioned description. That is to say, the present invention is not restricted to a specific circuit configuration. Description will be made below regarding such specific configurations.

Figure 7:
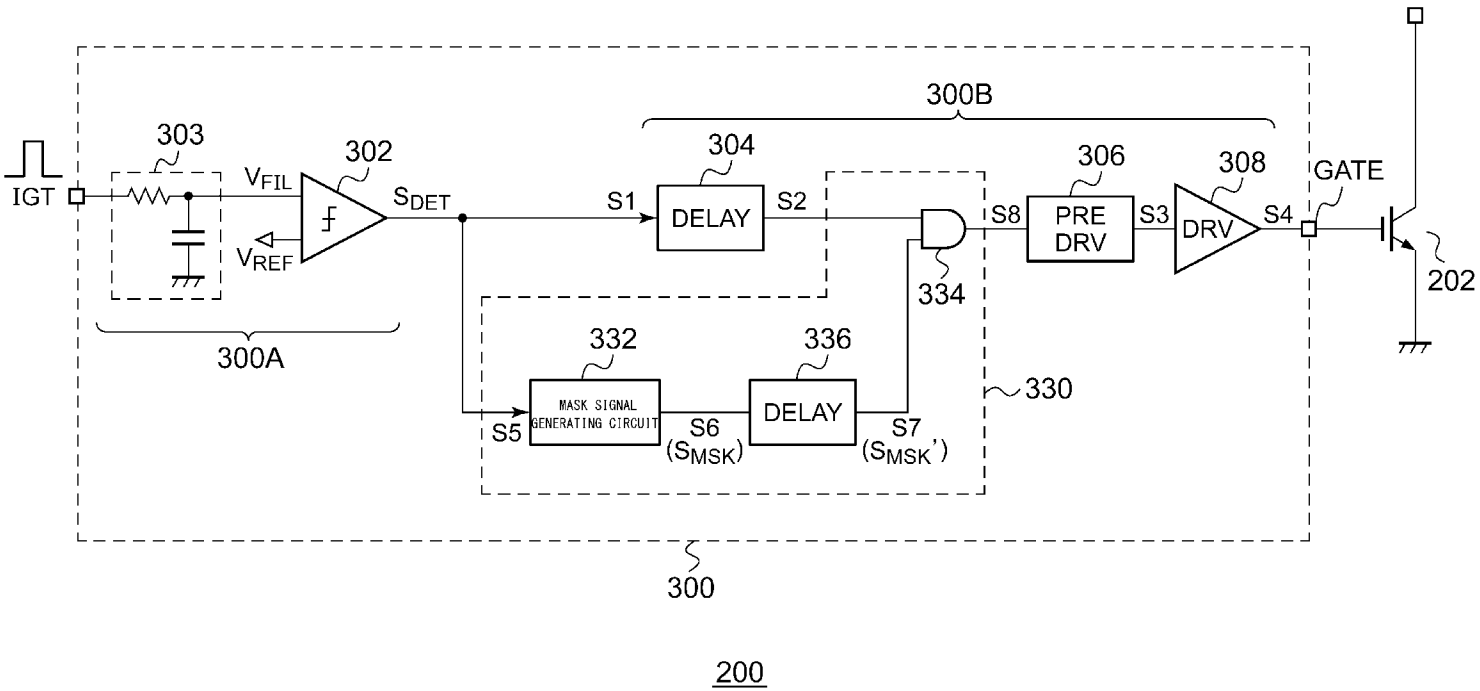
FIG. 7 is a circuit diagram showing a specific example configuration of the igniter.

FIG. 7 is a circuit diagram showing a specific example configuration of the igniter 200.

The high-frequency filter 303 is configured as a primary low-pass filter such as an RC filter or the like. The high-frequency filter 303 may be configured as an active filter. Also, the high-frequency filter 303 may be a second or higher order filter.

The off-state dead-time circuit 330 includes a mask signal generating circuit 332, a logic gate 334, and a delay circuit 336. The mask signal generating circuit 332 generates the mask signal $S_{MSK}$ which is set to a predetermined level (assumed to be low level hereafter) during the dead time $T_{DEAD}$ after the judgment signal $S_{DET}$ transits to negated level (low level) (i.e., after a negative edge occurs).

The delay circuit 336 is configured as a replica of the delay circuit 304, thereby applying the same amount of delay as that provided by the delay circuit 304 to the mask signal $S_{MSK}$.

The logic gate 334 performs a logical operation on a delayed mask signal $S_{MSK}'$ and the control signal S2 which instructs the switch element 202 to switch on and off, and which is generated according to the judgment signal $S_{DET}$. In other words, the off-state dead-time circuit 330 prohibits the transition of the gate signal S4 of the switch element 202 during the predetermined dead time $T_{DEAD}$ after the judgment signal $S_{DET}$ transits to the negated level (low level).

Figure 8:
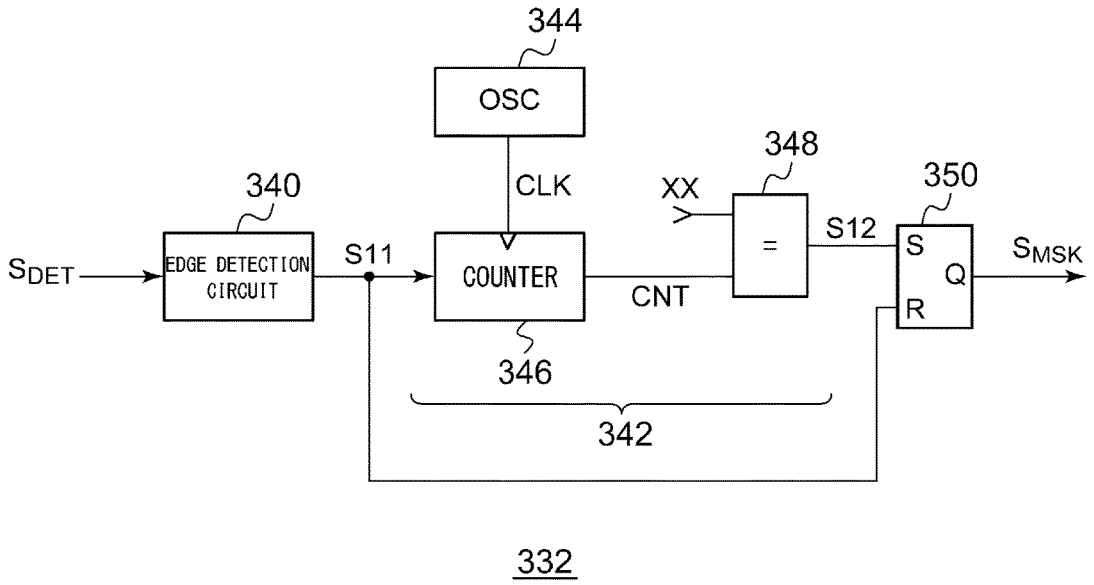
FIG. 8 is a circuit diagram showing an example configuration of a mask signal generating circuit.

FIG. 8 is a circuit diagram showing an example configuration of the mask signal generating circuit 332. Upon detection of a negative edge in the judgment signal $S_{DET}$, an edge detection circuit 340 asserts (sets to high level, for example) the start signal S11. A timer circuit 342 asserts (sets to high level, for example) an end signal S12 after the dead time $T_{DEAD}$ elapses after the start signal S11 is asserted. When the start signal S11 is asserted, the mask signal $S_{MSK}$ (S6), which is an output of a flip-flop 350, transits to a predetermined level (low level). In contrast, when the end signal S12 is asserted, the mask signal $S_{MSK}$ transits to a complementary level (high level) of the predetermined level. The flip-flop 350 may be configured as an SR flip-flop arranged such that its set terminal receives the end signal S12, and its reset terminal receives the start signal S11.

The timer circuit 342 includes an oscillator 344, a counter 346, and a digital comparator 348. The oscillator 344 generates a clock signal CLK having a predetermined frequency. Upon detection of the assertion of the start signal S11, the counter 346 starts a count operation according to the clock signal CLK. The digital comparator 348 compares the count value CNT obtained by the counter 346 with a setting value XX of the dead time $T_{DEAD}$). When the count value CNT matches the setting value XX, the digital comparator 348 asserts the end signal S12.

It should be noted that the configuration of the timer circuit 342 is not restricted to such an arrangement shown in FIG. 8. Also, the timer circuit 342 may be configured using an analog timer circuit.

Figure 9:
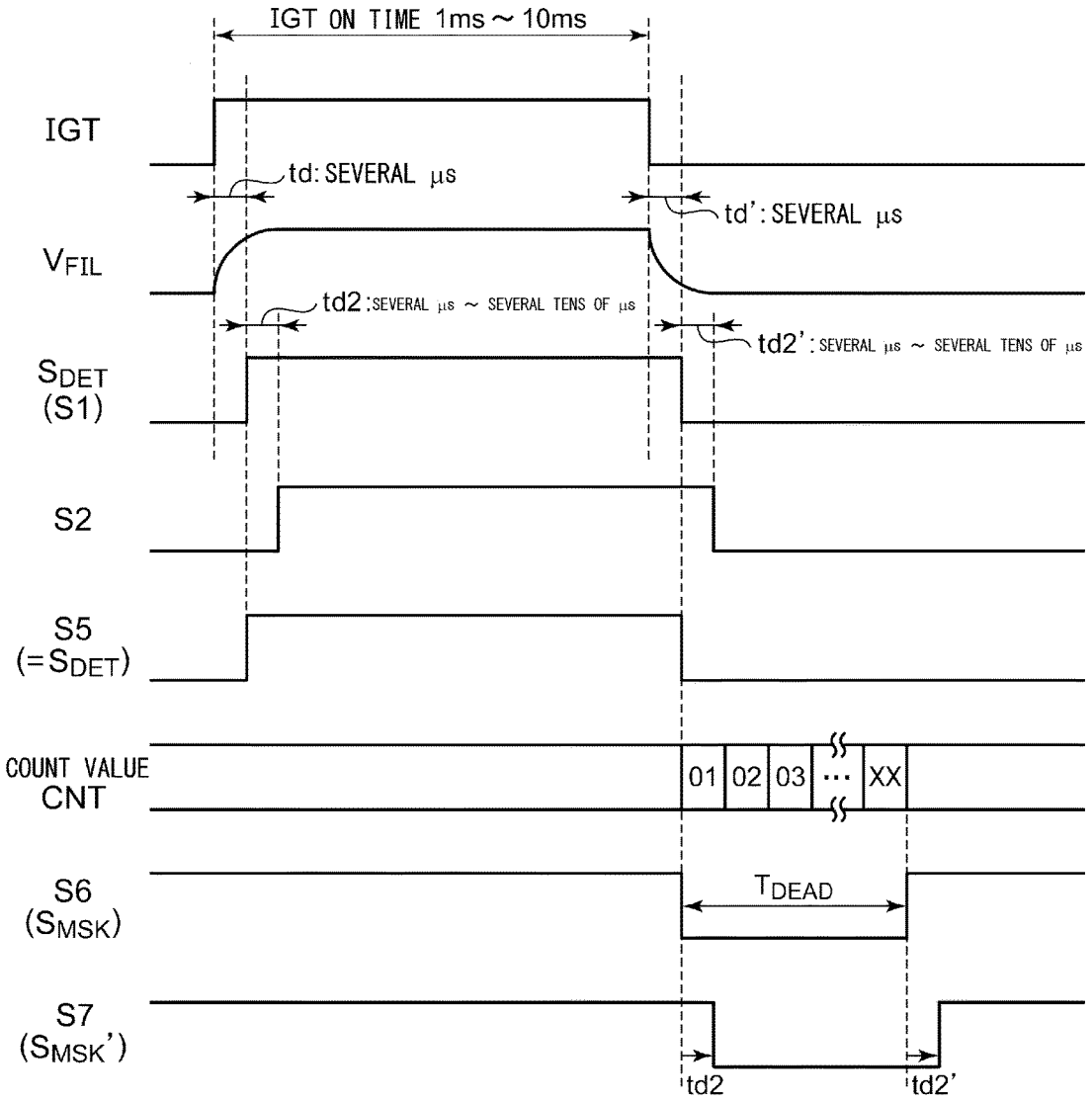
FIG. 9 is an operation waveform diagram showing the operation of the igniter shown in FIGS. 7 and 8.

FIG. 9 is an operation waveform diagram showing the operation of the igniter 200 shown in FIGS. 7 and 8. When the ignition signal IGT transits to high level, the output voltage $V_{FIL}$ of the high-frequency filter 303 rises. After a predetermined delay time td elapses, the judgment signal $S_{DET}$ is switched to high level. The judgment signal $S_{DET}$ is delayed by a delay time td2 by means of the delay circuit 304, so as to generate a delayed judgment signal S2. When the judgment signal $S_{DET}$ (S5) transits to low level, the mask signal $S_{MSK}$ (S6) is switched to low level. In this stage, the counter 346 starts the count operation so as to increment the count value CNT. When the count value CNT matches the setting value XX of the dead time $T_{DEAL}$ the mask signal $S_{MSK}$ (S6) is returned to high level.

The delay circuit 336 applies a delay time td2 to the mask signal $S_{MSK}$ (S6). A logical operation is performed on the mask signal $S_{SMSK}'$ (S7) thus delayed and the judgment signal S2 thus delayed, so as to generate a control pulse S8. The on/off switching operation of the switch element 202 is controlled according to the control pulse S8 thus generated.

Figure 10:
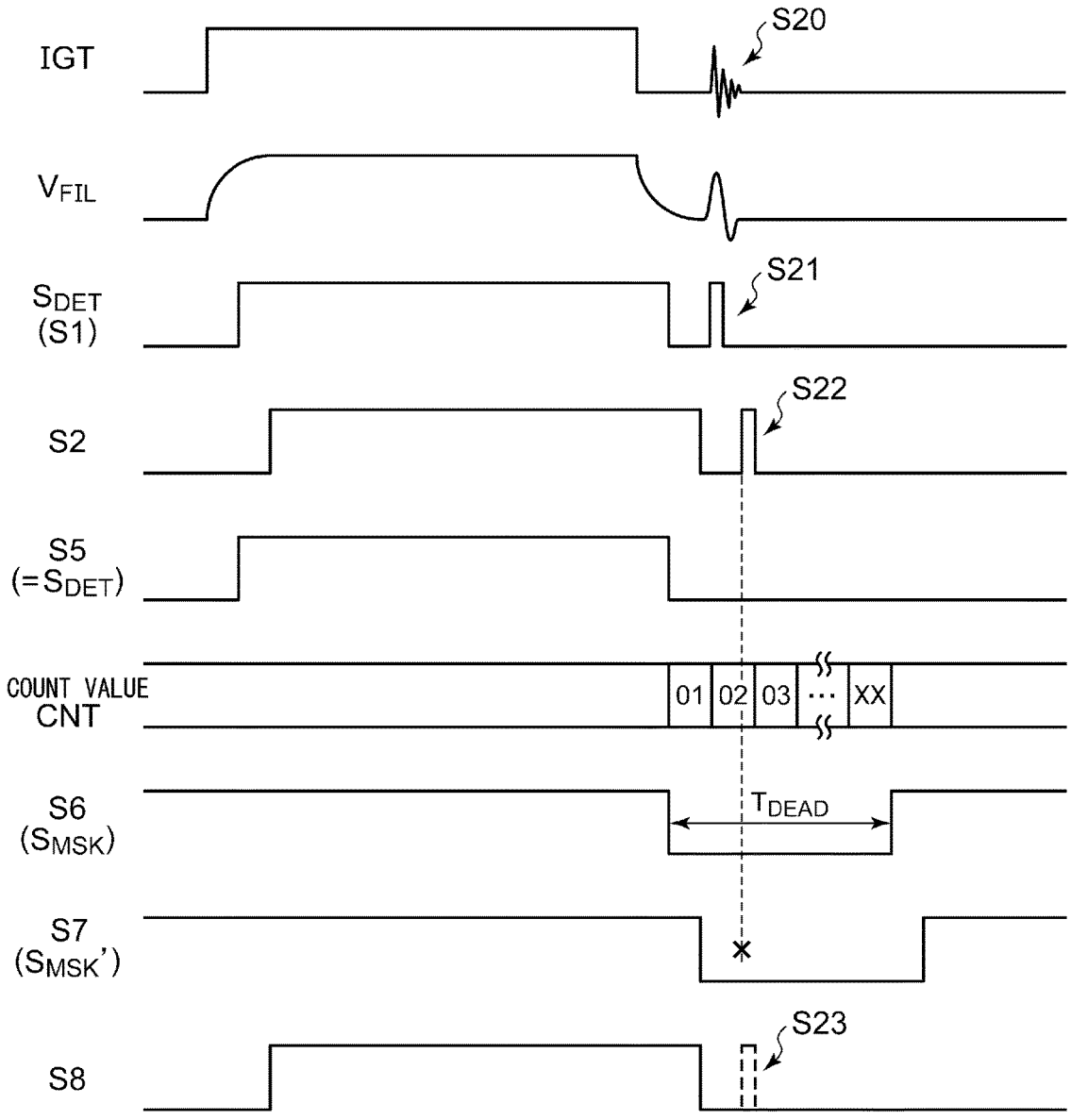
FIG. 10 is an operation waveform diagram showing the igniter shown in FIGS. 7 and 8 when cut-off noise is superimposed on the ignition signal.

FIG. 10 is an operation waveform diagram showing the operation of the igniter 200 shown in FIGS. 7 and 8 when cut-off noise is superimposed on the ignition signal IGT. When cut-off noise S20 occurs, pulse noise S21 occurs in the judgment signal $S_{DET}$. With an igniter according to conventional techniques, the signal S2 including such pulse noise S22 leads to undesired turning-on and turning-off of the switch element 202, resulting in the occurrence of abnormal ignition.

In contrast, with the igniter 200 according to the embodiment, the noise S22 is masked by the mask signal S6. Thus, the noise S23 is removed from the input S8 of the pre-driver 306. With such an arrangement, the switch element 202 cutting off again immediately after ignition does not occur, thereby preventing the occurrence of abnormal ignition.

The above-described embodiment has been described for exemplary purposes only, and is by no means intended to be interpreted restrictively. Rather, it can be readily conceived by those skilled in this art that various modifications may be made by making various combinations of the aforementioned components or processes, which are also encompassed in the technical scope of the present invention. Description will be made below regarding such modifications.

First Modification

Description has been made with reference to FIG. 7 regarding the off-state dead-time circuit 330 having a configuration in which the delay circuit 336 is provided as a downstream stage of the mask signal generating circuit 332. However, the present invention is not restricted to such an arrangement. Also, instead of applying such a delay by means of the delay circuit 336, the timer circuit 342 included within the mask signal generating circuit 332 may apply such a delay, for example. That is to say, the setting time set for the timer circuit 342 may be increased by the delay time td2.

Second Modification

Figure 11:
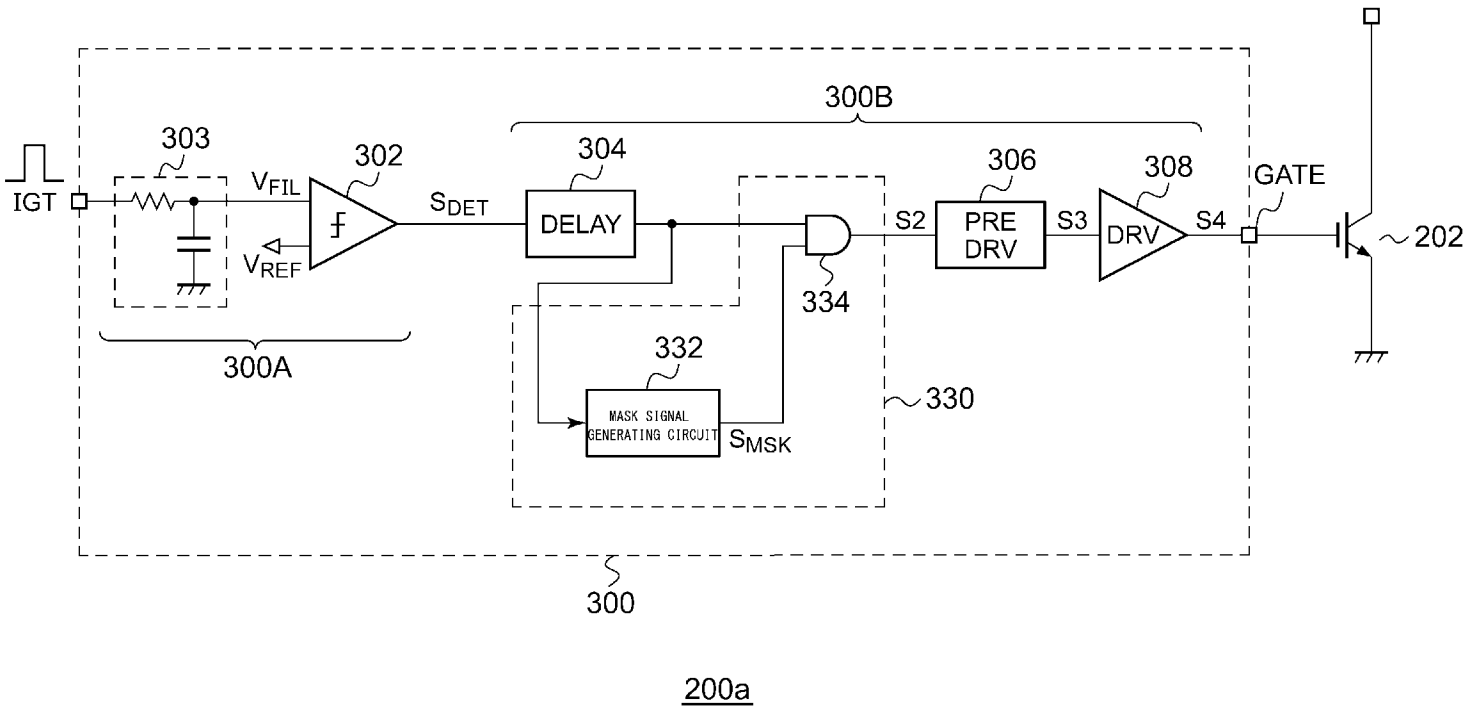
FIG. 11 is a circuit diagram showing an igniter according to a second modification.

FIG. 11 is a circuit diagram showing an igniter 200*a* according to a second modification. The mask signal generating circuit 332 generates the mask signal $S_{MSK}$ based on the judgment signal $S_{DET}'$ delayed by the delay circuit 304. The logic gate 334 performs a logical operation on the judgment signal $S_{DET}'$ and the mask signal $S_{MSK}$. Such a modification is capable of preventing cut-off from occurring again immediately after ignition.

Third Modification

It can be readily conceived by those skilled in this art that, in addition to the embodiments and the modifications as described for exemplary purposes, various modifications of the off-state dead-time circuit 330 may be made, which are also encompassed in the technical scope of the present invention. For example, an edge-trigger flip-flop (e.g., RS flip-flop or D flip-flop) may be employed instead of the logic gate 334.

While the preferred embodiments of the present invention have been described using specific terms, such description is for illustrative purposes only, and it is to be understood that changes and variations may be made without departing from the spirit or scope of the appended claims.

What is claimed is:

1. An igniter comprising:

a switch element connected to a primary coil of an ignition coil; and a switch control apparatus that controls the switch element according to an ignition signal supplied from an ECU (Engine Control Unit), wherein the switch control apparatus comprises:

an input line via which the ignition signal is supplied;

a filter that removes high-frequency noise from the input line;

a voltage comparator that compares an output voltage of the filter with a reference voltage, so as to generate a judgment signal;

a driving stage that controls an on/off switching operation of the switch element according to the judgment signal; and an off-state dead-time circuit that prohibits the driving stage from turning off the switch element during a predetermined dead time after the judgment signal transits to a negated level that corresponds to an off state of the switch element.

2. The igniter according to claim 1, wherein the off-state dead-time circuit comprises:

a mask signal generating circuit that receives the judgment signal, and that generates a mask signal which is set to a predetermined level during the dead time after the judgment signal transits to the negated level; and a logic gate that performs a logical operation on the mask signal and a control signal, wherein the control signal is generated according to the judgment signal and the control signal instructs the switch element to turn on and off.

3. The igniter according to claim 2, wherein the mask signal generating circuit comprises:

an edge detection circuit that asserts a start signal when a negative edge is detected in the judgment signal;

a timer circuit that asserts an end signal after the dead time elapses after the start signal is asserted; and a flip-flop that generates the mask signal, which is switched to the predetermined level when the start signal is asserted, and which is switched to a complementary level of the predetermined level when the end signal is asserted.

4. The igniter according to claim 1, wherein the switch control apparatus is monolithically integrated on a single semiconductor substrate.

5. A vehicle comprising:

a gasoline engine;

a spark plug;

an ignition coil comprising a primary coil and a secondary coil connected to the spark plug;

an ECU that generates an ignition signal configured as an instruction to ignite the spark plug; and the igniter according to claim 1, that drives the ignition coil according to the ignition signal.

6. An igniter comprising:

a switch element connected to a primary coil of an ignition coil; and a switch control apparatus that controls the switch element according to an ignition signal supplied from an ECU (Engine Control Unit), wherein the switch control apparatus comprises:

an input line via which the ignition signal is supplied;

a filter that removes high-frequency noise from the input line;

a voltage comparator that compares an output voltage of the filter with a reference voltage, so as to generate a judgment signal;

a driving stage that controls an on/off switching operation of the switch element according to the judgment signal, and wherein the switch element is maintained in an off state during a predetermined dead time after the judgment signal transits to a negated level that corresponds to an off state of the switch element.

7. A control method for an ignition coil connected to an spark plug, the control method comprising:

generating an ignition signal by means of an ECU (Engine Control Unit), which is an instruction to ignite the spark plug;

removing high-frequency noise from the ignition signal by means of a filter;

comparing an output voltage of the filter with a reference voltage, so as to generate a judgment signal;

controlling an on/off switching operation of a switch element connected to a primary coil of the ignition coil according to the judgment signal; and prohibiting the switch element from turning off during a predetermined dead time after the judgment signal transits to a negated level that corresponds to an off state of the switch element.

* * * * *